US007772754B2

(12) United States Patent
Lee et al.

(10) Patent No.: US 7,772,754 B2
(45) Date of Patent: Aug. 10, 2010

(54) ELECTRON EMISSION DISPLAY SPACER WITH FLATTENING LAYER AND MANUFACTURING METHOD THEREOF

(75) Inventors: Jae-Hoon Lee, Yongin-si (KR); Hyeong-Rae Seon, Yongin-si (KR); Cheol-Hyeon Chang, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 661 days.

(21) Appl. No.: 11/700,749

(22) Filed: Jan. 30, 2007

(65) Prior Publication Data

US 2007/0176530 A1 Aug. 2, 2007

(30) Foreign Application Priority Data

Jan. 31, 2006 (KR) ..... 10-2006-0009328

(51) Int. Cl.
*H01J 1/62* (2006.01)
*H01J 9/00* (2006.01)

(52) U.S. Cl. ..... 313/292; 313/495; 313/422; 313/310; 445/24; 445/23

(58) Field of Classification Search ..... 313/495, 313/422, 292
See application file for complete search history.

(56) References Cited

U.S. PATENT DOCUMENTS 6,255,772 B1 * 7/2001 Cathey et al. ..... 313/495
6,342,754 B1 * 1/2002 Kuroda et al. ..... 313/292
6,566,794 B1 * 5/2003 Miyazaki ..... 313/292
6,734,608 B1 5/2004 Barton et al.
7,315,115 B1 * 1/2008 Curtin et al. ..... 313/495
2004/0178492 A1 * 9/2004 Tsukamoto et al. ..... 257/690
2007/0090742 A1 * 4/2007 Jin ..... 313/292

FOREIGN PATENT DOCUMENTS

CN 1282448 A 1/2001
EP 1 032 014 A2 8/2000
EP 1 137 041 A1 9/2001
EP 1 032 014 A3 6/2007
JP 2000-113804 A 4/2000
JP 2000-251705 9/2000

OTHER PUBLICATIONS

European Search Report dated Jul. 11, 2007, for EP 07101392.4, in the name of Samsung SDI Co., Ltd.

* cited by examiner

*Primary Examiner*—Sikha Roy
(74) *Attorney, Agent, or Firm*—Christie, Parker & Hale, LLP

(57) ABSTRACT

An electron emission display is provided to prevent electron beams around the spacers from being distorted and to prevent arc discharging due to the spacers. The electron emission display includes first and second substrates facing each other to form a vacuum vessel, an electron emission unit provided on the first substrate, a light emission unit provided on the second substrate, and a plurality of spacers disposed between the first and the second substrates. Each spacer has a spacer body with a surface roughness, a resistance layer placed on a lateral side of the spacer body, and a flattening layer covering the resistance layer. The flattening layer has a thickness larger than the thickness of the resistance layer and a surface roughness smaller than the surface roughness of the spacer body.

18 Claims, 6 Drawing Sheets

ELECTRON EMISSION DISPLAY SPACER WITH FLATTENING LAYER AND MANUFACTURING METHOD THEREOF

CROSS-REFERENCE TO RELATED APPLICATION

This application claims priority to and the benefit of Korean Patent Application No. 10-2006-0009328 filed on Jan. 31, 2006 in the Korean Intellectual Property Office, the entire content of which is incorporated herein by reference.

BACKGROUND OF THE INVENTION (a) Field of the Invention

The present invention relates to electron emission displays, and in particular, to spacers mounted within a vacuum vessel of an electron emission display.

(b) Description of Related Art

Generally, electron emission devices are classified, depending upon the kinds of electron sources, into a hot cathode type and a cold cathode type.

Of the cold cathode type there are the field emission array (FEA) type, the surface-conduction emission (SCE) type, the metal-insulator-metal (MIM) type, and the metal-insulator-semiconductor (MIS) type.

Arrays of electron emission elements are typically arranged on a first substrate to form an electron emission unit, and a light emission unit is formed on a surface of a second substrate facing the first substrate and having phosphor layers and an anode electrode, thereby constructing an electron emission display.

The electron emission unit has electron emission regions, and driving electrodes with scan electrodes and data electrodes to emit the intended amount of electrons toward the second substrate per the respective pixels. The light emission unit excites the phosphor layers with the electrons emitted from the electron emission regions to emit visible rays and display desired images.

The first and second substrates are sealed to each other at their peripheries using a sealing member, and the internal space between the first and second substrates is evacuated to be about $10^{-6}$ Torr, thereby constructing a vacuum vessel together with the sealing member. The vacuum vessel is highly pressurized due to the pressure difference between the interior and exterior thereof. Accordingly, a plurality of spacers are mounted between the first and second substrates to space the substrates apart from each other at a predetermined distance.

The spacers are formed with a material bearing a pressure-resistant but nearly non-conductive material to effectively endure the pressure applied to the vacuum vessel and to prevent an electrical short circuit between the electron emission unit and the light emission unit. In this regard, the common spacers are formed with a dielectric material such as glass and ceramic, and are processed using a diamond wheel or a laser cutter to provide a predetermined shape.

The spacers formed with a dielectric are liable to be charged at the surface thereof under the collision of electron beams there against so that the trajectories of electron beams around the spacers are distorted. Accordingly, a high resistance layer based on chromium oxide ($Cr_2O_3$) is formed on the lateral side of the spacers to thereby prevent the spacers from being surface-charged.

However, micro-cracks or micro-pores are present at the surface of the spacer body, and hence, the spacer body has a predetermined surface roughness. Consequently, when a resistant material is coated onto the spacers to form a resistance layer, the coating of the resistance layer on the spacers is only partially made. The spacers with no resistance layer are surface-charged so that the trajectories of electron beams are distorted, thereby generating unintended light emission.

Furthermore, even when a resistance layer is formed on the spacers, they may still have an uneven surface, and with the operation of the electron emission display, electric fields are concentrated on the surface of the spacers so that the arc discharging may occur within the vacuum vessel. The arc discharging causes the breakage of the built-in structure of the electron emission display, thereby resulting in product failure.

SUMMARY OF THE INVENTION

In one exemplary embodiment of the present invention, there is provided an electron emission display which has spacers with reduced surface roughness to prevent the abnormal light emission and the arc discharging.

According to one exemplary embodiment of the present invention, spacers are disposed between first and second substrates forming a vacuum vessel together with a sealing member to endure the pressure applied to the vacuum vessel. Each spacer has a spacer body with a surface roughness, a resistance layer placed on at least one lateral side of the spacer body, and a flattening layer covering the resistance layer. The flattening layer has a thickness larger than that of the resistance layer, and a surface roughness smaller than that of the spacer body.

The resistance layer may have a specific resistance of $10^5$-$10^8$ Ωcm, and a thickness of 0.5-1 μm.

The flattening layer may have a thickness of 1-1.5 μm, and a surface roughness of 0.01-0.1 μm. The flattening layer may be formed from an insulating material or a resistant material with a specific resistance greater than that of the resistance layer.

In a method of manufacturing the spacer, a spacer body with a surface roughness is formed by patterning a spacer body material. A resistant material is coated onto at least one lateral side of the spacer body to form a resistance layer covering the lateral side of the spacer body. A flattening layer is formed on the resistance layer with a thickness larger than that of the resistance layer and a surface roughness smaller than that of the spacer body.

The formation of the flattening layer may be made either by spraying or by dipping, and the flattening layer may be surface-treated. The flattening layer may be formed from an insulating material or a material having a specific resistance greater than that of the resistance layer.

According to another exemplary embodiment of the present invention, an electron emission display includes first and second substrates facing each other to form a vacuum vessel, an electron emission unit provided on the first substrate, a light emission unit provided on the second substrate, and a plurality of spacers disposed between the first and second substrates. Each spacer has a spacer body with a surface roughness, a resistance layer placed on a lateral side of the spacer body, and a flattening layer covering the resistance layer. The flattening layer has a thickness larger than that of the resistance layer and a surface roughness smaller than that of the spacer body.

The resistance layer may have a specific resistance of $10^5$-$10^8$ Ωcm, and a thickness of 0.5-1 μm. The flattening layer may have a thickness of 1-1.5 μm, and a surface roughness of 0.01-0.1 μm.

The electron emission unit may have cathode and gate electrodes insulated from each other, and electron emission regions electrically connected to the cathode electrodes.

Alternatively, the electron emission unit may have first and second conductive thin films spaced from each other, first and second electrodes electrically connected to the first and second conductive thin films, and electron emission regions disposed between the first and second conductive thin films.

The light emission unit may have phosphor layers, a black layer disposed between the phosphor layers, and an anode electrode placed on one surface of the phosphor and the black layers.

The first and second substrates have an active area with the electron emission unit and the light emission unit, respectively, and a non-active area placed external to the active area. The spacers include first spacers placed at the active area, and second spacers placed at the non-active area.

DETAILED DESCRIPTION

Figure 1A:
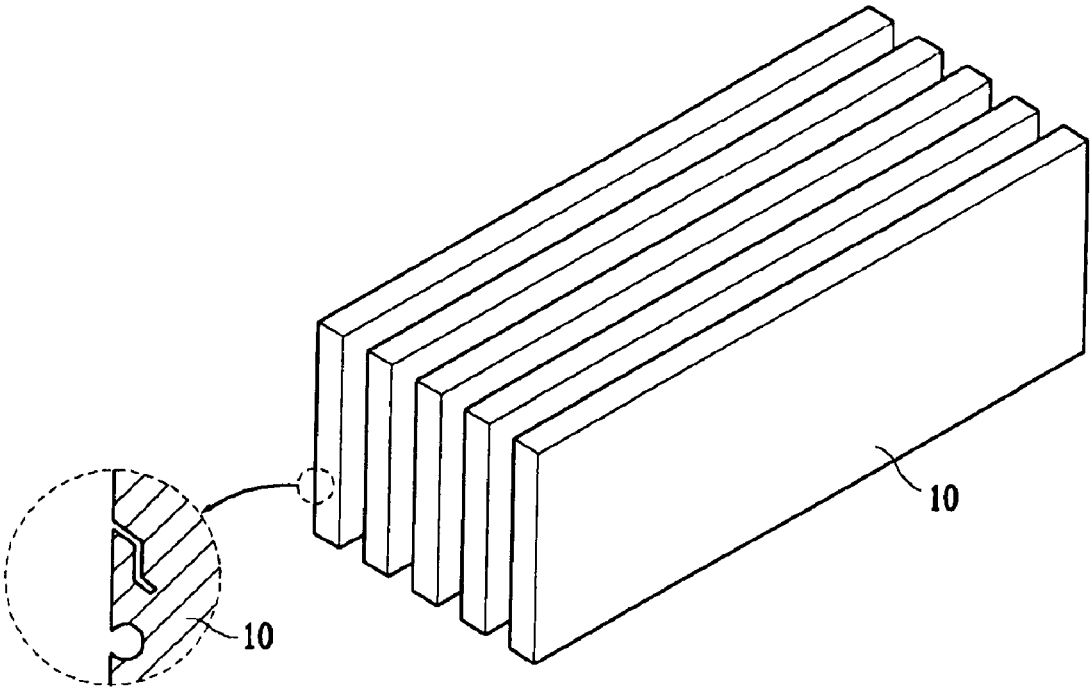
FIGS. 1A, 1B and 1C schematically illustrate the steps of manufacturing spacers according to an embodiment of the present invention.

As shown in FIG. 1A, a pressure-resistant spacer material is prepared, and cut to a predetermined shape using a cutter, such as a diamond wheel and a laser cutter, to thereby form a spacer body 10.

The spacer material is formed with any one of glass, ceramic, reinforced glass, and various other materials currently used in forming spacers. The spacer body 10 may be formed in the shape of a bar, a pillar, or various other shapes. A bar-shaped spacer body is illustrated in the drawing.

Alternatively, the spacer body 10 may be formed of a photosensitive glass material, and completed by patterning it through partial light exposing, heat treating and etching.

As seen in the magnified portion of FIG. 1A, micro-cracks or micro-pores are present at the surface of the completed spacer body 10, which has a surface roughness of 0.12-0.2 μm.

Figure 1B:
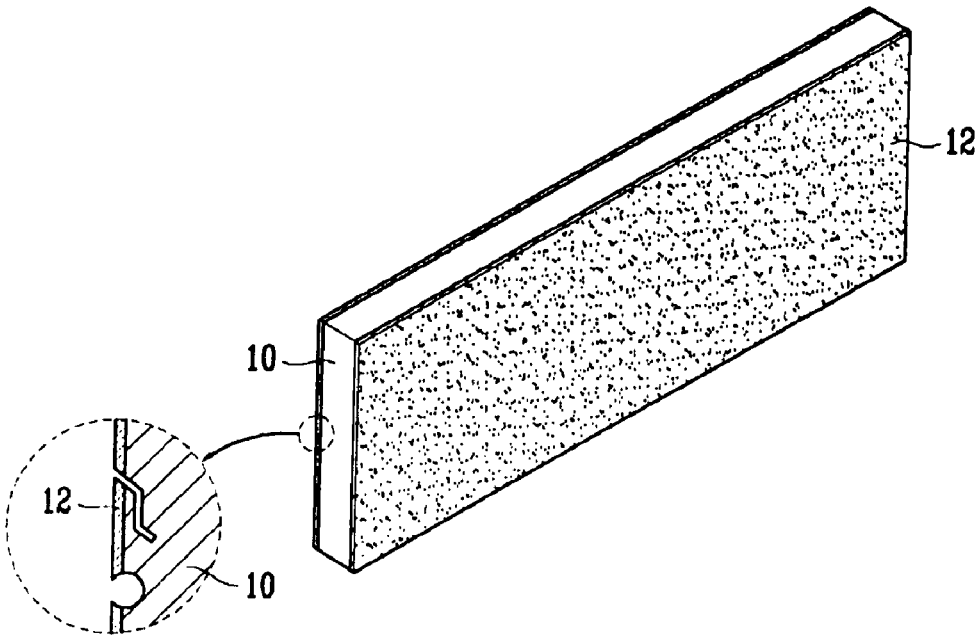

As shown in FIG. 1B, a resistance layer 12 is formed by coating a resistant material onto the lateral sides of the spacer body 10. The resistance layer 12 has the role of providing movement routes of electrons such that the electrons colliding against the surface of the spacers flow out to an electron emission unit (not shown) or to a light emission unit (not shown), preventing the spacers from being surface-charged.

The resistance layer 12 is designed to prevent the electron emission unit and the light emission unit from being short circuited with each other through the spacer, and to provide the movement routes of the electrons. For this purpose, the resistance layer 12 has a specific resistance of roughly $10^5$-$10^8$ Ωcm. For instance, the resistance layer 12 may be formed with $Cr_2O_3$.

In order to maintain the above-identified specific resistance value, the resistance layer 12 may be roughly formed with a thin thickness of 0.5-1 μm. Accordingly, the resistance layer 12 may not fill the surface micro-cracks or micro-pores of the spacer body 10 sufficiently, and may be only partially formed on the surface of the spacer body 10 due to the surface roughness of the spacer body 10.

Figure 1C:
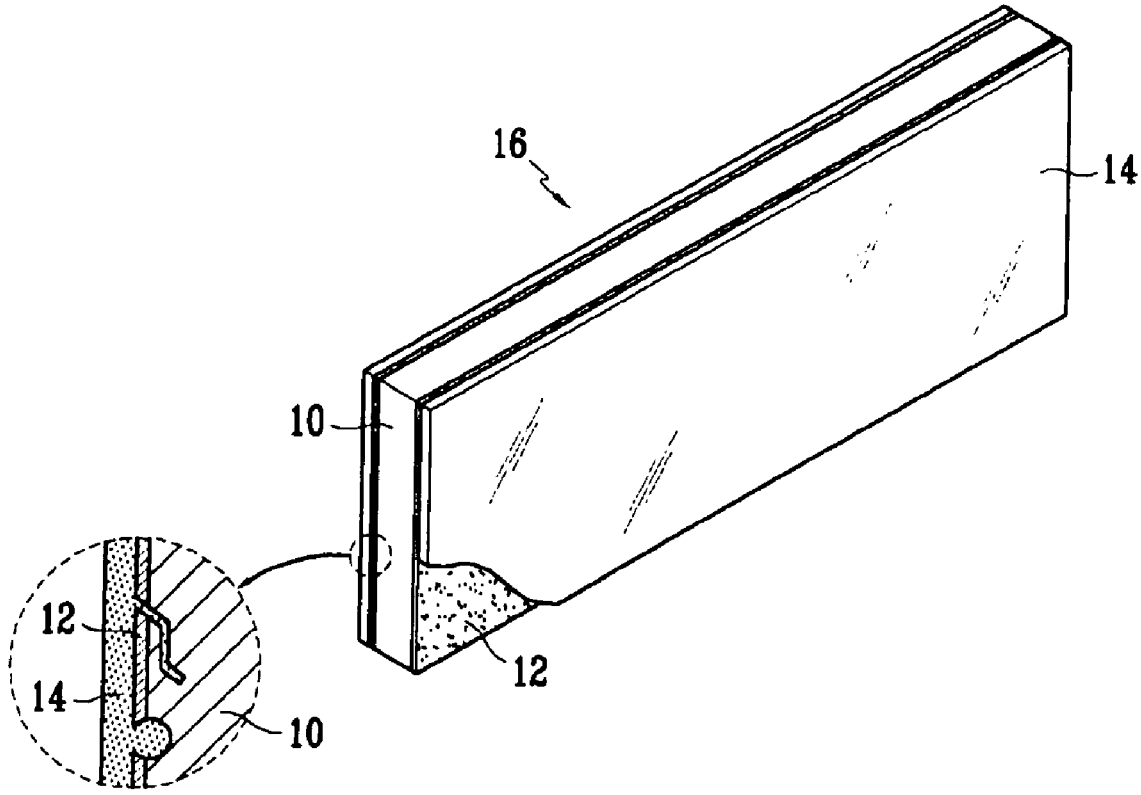

However, as shown in FIG. 1C, a flattening layer 14 is formed on the surface of the resistance layer 12 with a thickness larger than that of the resistance layer 12. The flattening layer 14 roughly has a thickness of 1-1.5 μm, and sufficiently covers the spacer body 10 and the resistance layer 12 such that it fills the surface micro-cracks and micro-pores of the spacer body 10. The flattening layer 14 is not influenced by the surface roughness of the spacer body 10 and the resistance layer 12, and has an external surface with an extremely small surface roughness of 0.01-0.1 μm.

The flattening layer 14 is formed with an insulating material, or a resistant material having a specific resistance greater than that of the resistance layer 12. For instance, the flattening layer 14 may be formed with polyimide (PI). The flattening layer 14 may be formed in various ways, such as spraying and dipping, and have the above-identified surface roughness range through the surface treatment process.

With the spacers 16 according to the present embodiment, the movement routes of electrons are provided through the resistance layer 12 having the above-identified specific resistance value, thereby preventing the spacers 16 from being surface-charged. Furthermore, the spacer 16 prevents the surface of the spacer body 10 based on the dielectric material from being exposed by the flattening layer 14 having the above-identified thickness and surface roughness, and minimizes the surface roughness, thereby preventing the arc discharging with the mounting thereof within the vacuum vessel.

Figure 2:
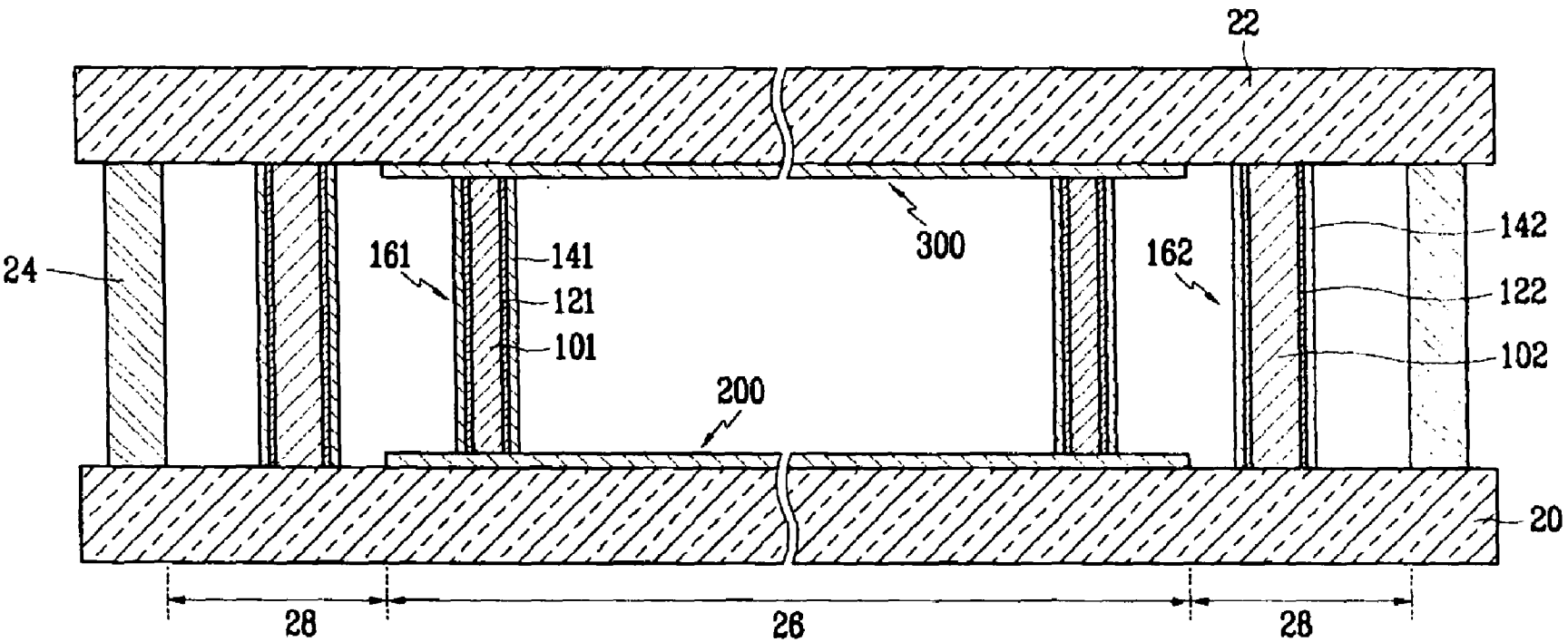
FIG. 2 is a schematic sectional view of an electron emission display according to an embodiment of the present invention.

FIG. 2, according to an embodiment of the present invention, is a schematic sectional view of an electron emission display having the above-described spacers.

As shown in FIG. 2, the electron emission display includes first substrate 20 and second substrate 22 facing each other in parallel at a predetermined distance. A sealing member 24 is provided at the peripheries of the first and second substrates 20, 22 to seal the substrates to each other, and the internal space between the first and second substrates 20, 22 is evacuated to be about $10^{-6}$ Torr, thereby forming a vacuum vessel.

The first and second substrates 20, 22 have an active area 26 internal to the sealing member 24 which serves to emit visible rays, and a non-active area 28 surrounding the active area 26. An electron emission unit 200 is provided at the active area 26 of the first substrate 20 to emit electrons, and a light emission unit 300 is provided at the active area of the second substrate 22 to emit visible rays.

A plurality of spacers 161, 162 are provided between the first and second substrates 20, 22 to endure the pressure applied to the vacuum vessel and space the two substrates from each other with a predetermined distance. The spacers 161 are provided in the active area 26 and the spacers 162 are provided in the non-active area 28. For explanatory convenience, the spacers placed at the active area 26 are called the first spacers 161, and the spacers placed at the non-active area 28 are called the second spacers 162.

The first spacers 161 are so small in width that they are not seen from the sight of the user during the operation of the electron emission display. Since the limitation in width of the second spacers 162 is not so great as compared to that of the first spacers 161, the spacer body 102 of the second spacer 162 may be formed to be larger in width than the spacer body 101 of the first spacer 161.

The first and second spacers 161, 162 have spacer bodies 101, 102, resistance layers 121, 122 placed at the lateral sides of the spacer bodies 101, 102, and flattening layers 141, 142 placed on the surfaces of the resistance layers 121, 122, respectively. The surface roughness of the spacer bodies 101, 102, the thickness and specific resistance of the resistance layers 121, 122, and the thickness and surface roughness of the flattening layers 141, 142 are the same as those mentioned in relation to the method of manufacturing the spacers.

The internal structure and spacer operation of the FEA type electron emission display will be now explained with reference to FIGS. 3 and 4, and the internal structure and spacer operation of the SCE type electron emission display with reference to FIG. 5.

Figure 3:
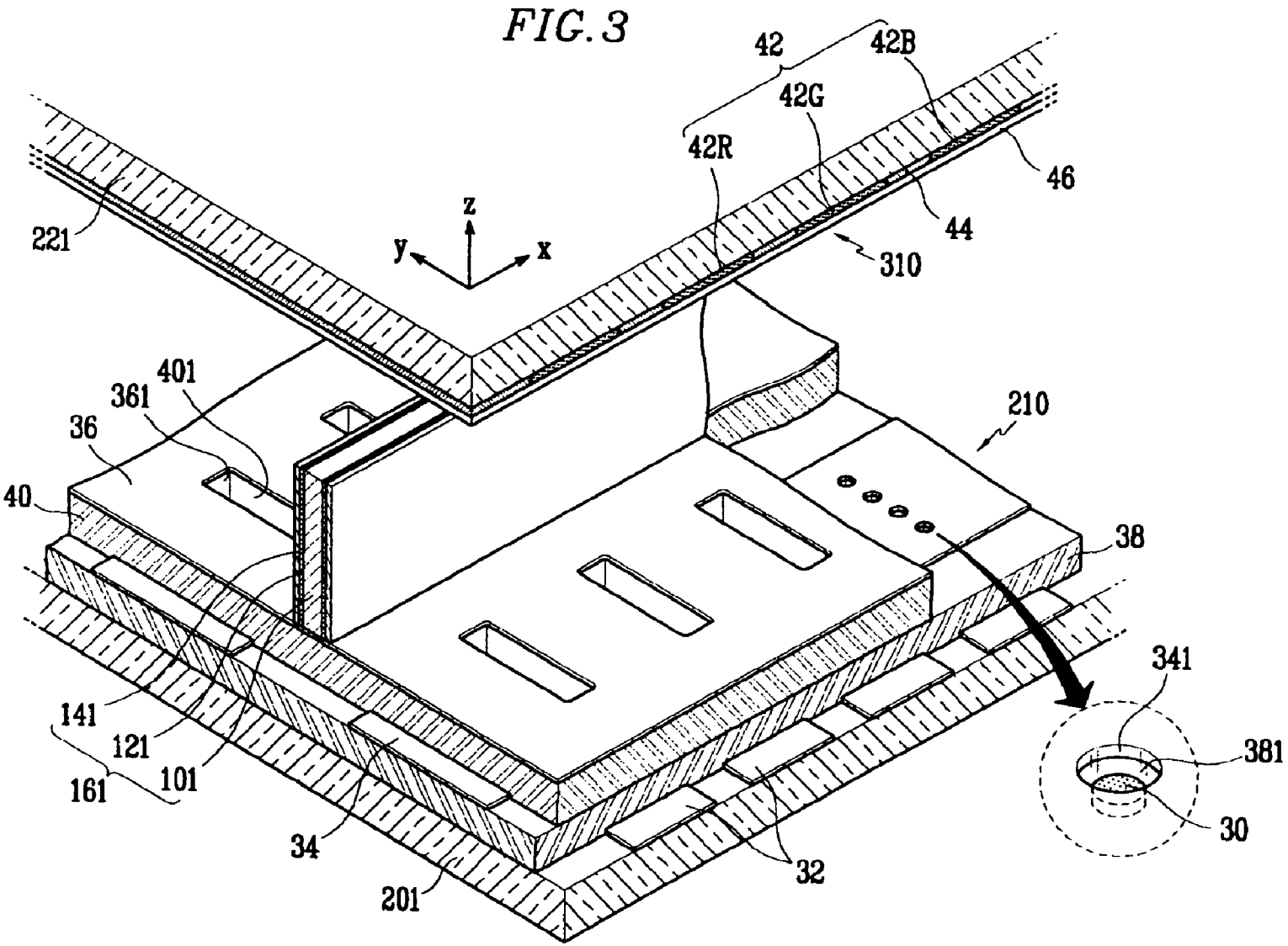
FIG. 3 is a partial exploded perspective view of an FEA type electron emission display according to an embodiment of the present invention.
Figure 4:
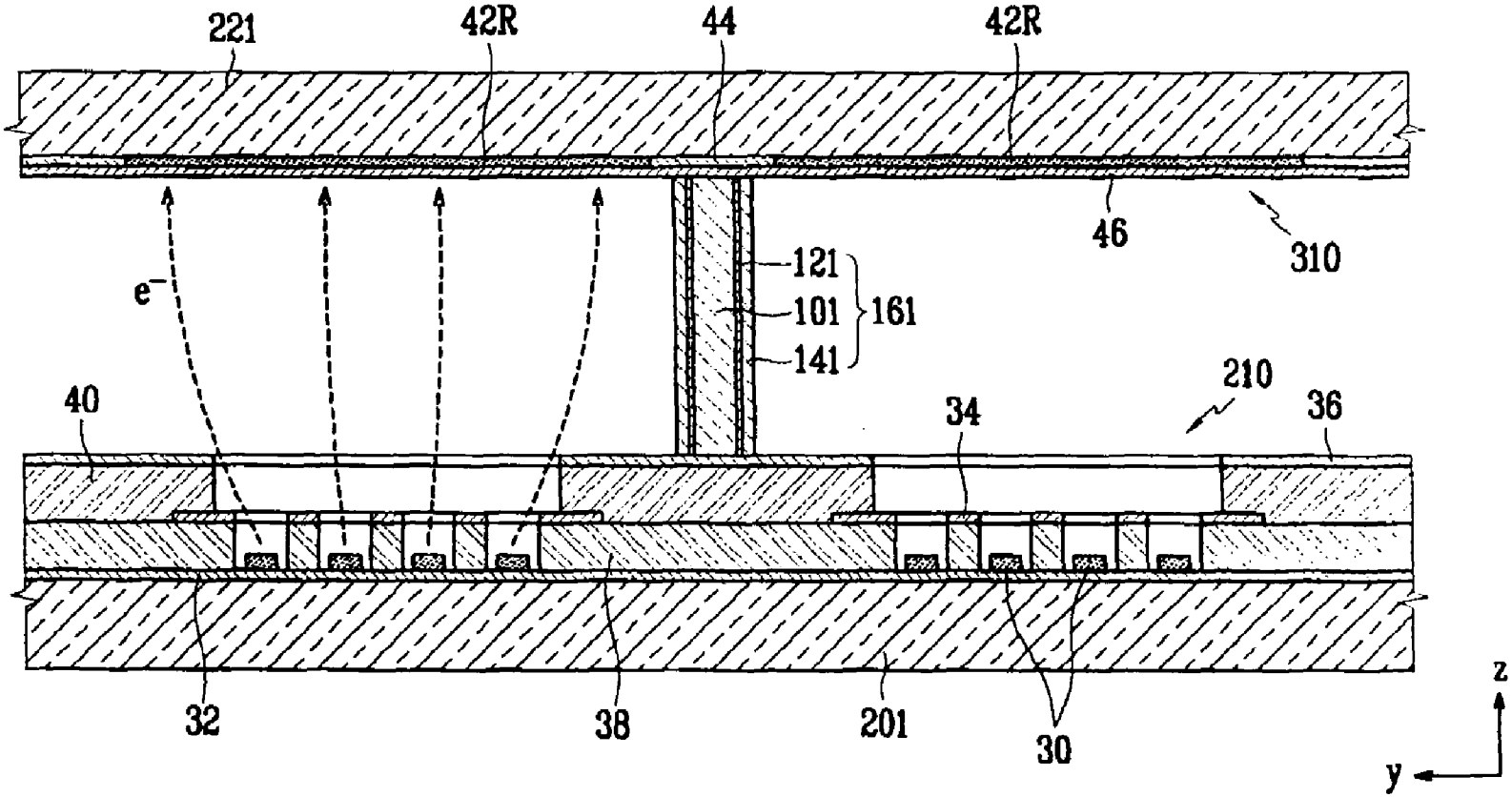
FIG. 4 is a partial sectional view of an FEA type electron emission display according to an embodiment of the present invention.

As shown in FIGS. 3 and 4, with the FEA type electron emission display, the electron emission unit 210 includes electron emission regions 30, cathode electrodes 32, gate electrodes, 34, and a focusing electrode 36 for focusing the electron beams.

Specifically, cathode electrodes 32 are stripe-patterned on the first substrate 201 in a direction of the first substrate 201, and a first insulating layer 38 is formed on the entire surface of the first substrate 201 such that it covers the cathode electrodes 32. Gate electrodes 34 are stripe-patterned on the first insulating layer 38 such that they cross the cathode electrodes 32.

In this embodiment, when the crossed regions of the cathode and gate electrodes 32, 34 are defined as the pixels, electron emission regions 30 are formed on the cathode electrodes 32 at the respective pixels, and openings 381 are formed at the first insulating layer 38, and openings 341 are formed at the gate electrodes 34 corresponding to the respective electron emission regions 30 such that the electron emission regions 30 are exposed on the first substrate 201 therethrough.

The electron emission regions 30 are formed of a material emitting electrons when an electric field is applied thereto under a vacuum atmosphere, such as a carbonaceous material and a nanometer-sized material. For instance, the electron emission regions 30 may be formed with carbon nanotube, graphite, graphite nanofiber, diamond, diamond-like carbon, fullerene $C_{60}$, silicon nanowire, or a combination thereof, through screen-printing, direct growth, sputtering, or chemical vapor deposition.

Alternatively, the electron emission regions may be formed with a sharp-pointed tip structure mainly based on molybdenum (Mo) or silicon (Si).

It is illustrated in the drawings that the circular-shaped electron emission regions 30 are linearly arranged in the longitudinal direction of the cathode electrodes 32. However, the shape, number per pixel and arrangement of the electron emission regions 30 are not limited to that illustrated, but may be altered in various manners.

A focusing electrode 36 is formed on the gate electrodes 34 and the first insulating layer 38. A second insulating layer 40 is placed under the focusing electrode 36 to insulate the gate electrodes 34 from the focusing electrode 36, and openings 361 are formed at the focusing electrode 36 and openings 401 are formed at the second insulating layer 40 to pass the electron beams.

The focusing electrodes 36 have openings corresponding to the respective electron emission regions 30 to separately focus the electrons emitted from the respective electron emission regions 30. Alternatively, one opening 361 is formed at each pixel to collectively focus the electrons emitted from the pixel. FIG. 3 illustrates the second case.

The light emission unit 310 includes phosphor layers 42, a black layer disposed between the neighboring phosphor layers 42, and an anode electrode 46 placed on a surface of the phosphor and black layers 42, 44.

The phosphor layers 42 include red, green and blue phosphor layers 42R, 42G, 42B such that one colored phosphor layer is placed at each crossed region of the cathode and gate electrodes 32, 34. The black layer 44 is placed between the respective phosphor layers 42 in the shape of a matrix to enhance the screen contrast.

The anode electrode 46 is formed of an aluminum-like metallic layer placed on a surface of the phosphor and the black layers 42, 44 directed toward the first substrate 201. The anode electrode 46 receives from the outside a high voltage required to make the phosphor layers 42 be in a high potential state for accelerating the electron beams, and reflects the visible rays radiated from the phosphor layers 42 to the first substrate 201 toward the second substrate 221, thereby enhancing the screen luminance.

Alternatively, the anode electrode may be formed with a transparent conductive layer such as indium tin oxide (ITO). In this case, the anode electrode is placed on a surface of the phosphor and black layers 42, 44 directed toward the second substrate 221. It is also possible to simultaneously form the metallic layer and the transparent conductive layer as the anode electrode.

The first spacers 161 correspond to the black layer 44 such that they do not intrude upon the area of the phosphor layers 42. The first spacer 161 has a spacer body 101 roughly with a surface roughness of 0.12-0.2 μm, a resistance layer 121 placed on the lateral side of the spacer body 101 with a thickness of 0.5-1 μm and a specific resistance of $10^5$-$10^8$ Ωcm, and a flattening layer 141 placed on a surface of the resistance layer 121 roughly with a thickness of 1-1.5 μm and a surface roughness of 0.01-0.1 μm.

A conductive adhesive layer (not shown) is placed on a surface of the first spacer 161 directed toward the first substrate 201 or a surface of the first spacer 161 directed toward the second substrate 221 to electrically connect the resistance layer 121 to the focusing electrode 36 or the resistance layer 121 to the anode electrode 46.

Although not shown in the drawings, second spacers are placed at the non-active area of the first and second substrates 201, 221 having a width larger than that of the first spacers 161. The second spacers have the same general structure as that of the first spacers 161 except for the width of the spacer body thereof.

The above-structured electron emission display is driven by supplying predetermined voltages to the cathode electrodes 32, the gate electrodes 34, the focusing electrode 36 and the anode electrode 46 from the outside.

For instance, one of the cathode and gate electrodes 32, 34 receives a scan driving voltage, and the other electrode receives a data driving voltage. The focusing electrode 36 receives a voltage required for accelerating the electron beams, for example, 0V or a negative direct current voltage, and the anode electrode 46 receives a voltage required for accelerating electron beams, for example, a positive direct current voltage of several hundreds to several thousands volts.

Electric fields are then formed around the electron emission regions 30 at the pixels where the voltage difference between the cathode and the gate electrodes 32, 34 exceeds the threshold value, and electrons are emitted from those electron emission regions 30. The emitted electrons pass through the openings 361 of the focusing electrode 36, and are focused at the centers of the bundles of electron beams. The focused electrons are attracted by the high voltage applied to the anode electrode 46, and collide against the phosphor layers 42 at the relevant pixels, thereby exciting the phosphor layers to emit light.

With the above driving process, the electrons emitted from the respective electron emission regions 30 are diffused at a predetermined diffusion angle even under the operation of the focusing electrode 36. Accordingly, although some of the electrons collide against the surface of the first spacers 161, those electrons flow to the focusing electrode 36 or the anode electrode 46 through the resistance layer 121, thereby preventing the first spacers 161 from being surface-charged.

Furthermore, since the flattening layer 141 of the first spacer 161 prevents the surface of the spacer body 101 based on the dielectric material from being exposed so that the surface charging at the area with no resistance layer 121 may be prevented. Since the first and second spacers have a smooth surface due to the flattening layer, the arc discharging induced by the spacers can be effectively prevented.

Figure 5:
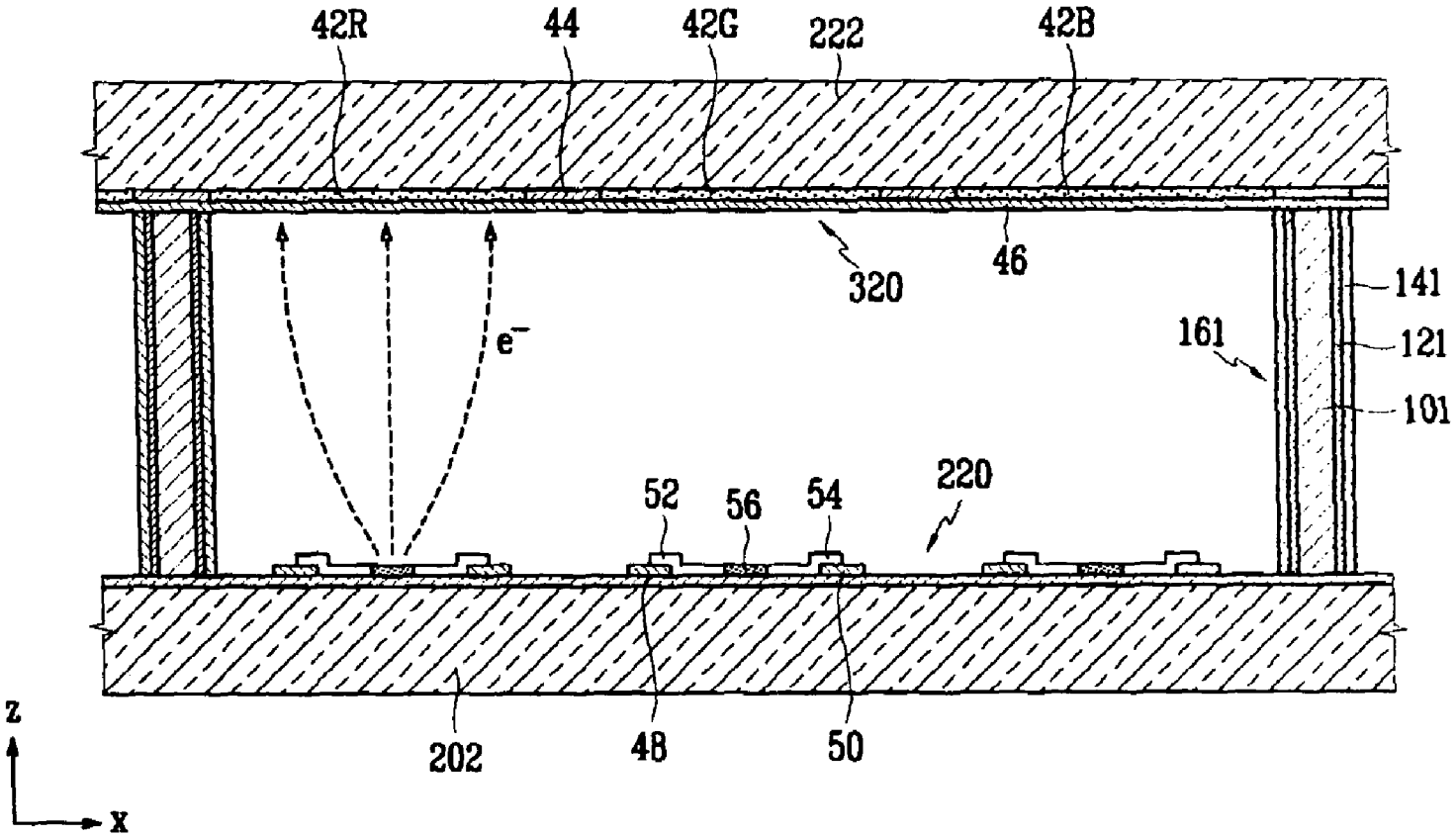
FIG. 5 is a partial sectional view of an SCE type electron emission display according to an embodiment of the present invention.

As shown in FIG. 5, with an SCE type electron emission display the electron emission unit 220 includes first and second electrodes 48, 50 spaced apart from each other at a distance, first and second conductive thin films 52, 54 provided at the respective first and second electrodes 48, 50, and electron emission regions 56 disposed between the first and second conductive thin films 52, 54.

The first and second electrodes 48, 50 may be formed of various conductive materials. The first and second conductive thin films 52, 54 may be formed with a micro-particle thin film based on a conductive material such as nickel (Ni), gold (Au), platinum (Pt), and palladium (Pd).

The electron emission regions 56 may be formed with micro-cracks provided between the first and second conductive thin films 52, 54, or with a layer containing a carbon compound. In the second case, the electron emission regions 56 may contain carbon nanotube, graphite, graphite nanofiber, diamond, diamond-like carbon, fullerene $C_{60}$, or a combination thereof.

The light emission unit 320 may have the same structure as that of the light emission unit of the previously-described FEA type electron emission display. The first spacers 161 placed at the active area and the second spacers (not shown) placed at the non-active area also have the same structure as that of the spacers of the previously-described electron emission display. For explanatory convenience, like reference numerals will be used for the same structural components as those related to the FEA type electron emission display, and detailed explanation thereof will be omitted.

With the SCE type electron emission display, when predetermined driving voltages are applied to the first and second electrodes 48, 50, electric currents flow parallel to the surface of the electron emission regions 56 through the first and second conductive thin films 52, 54 to thereby make the surface conduction type electron emission. The emitted electrons are attracted by the high voltage applied to the anode electrode 46, and directed toward the second substrate 222, thereby hitting the phosphor layers 42 to emit light.

With the above driving process, the electrons emitted from the respective electron emission regions 56 are diffused at a predetermined diffusion angle so that some of the electrons collide against the surface of the first spacers 161. However, since those electrons flow to the anode electrode 46 through the resistance layer 121, the first spacer 161 may be prevented from being surface-charged.

Furthermore, since the flattening layer 141 of the first spacer 161 prevents the surface of the spacer body 101 from being exposed, the surface charging of the first spacers 161 at the area with no resistance layer 121 is prevented. Since the flattening layer has an extremely small surface roughness, the first and second spacers may effectively prevent arc discharging induced by the spacers.

Although the embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A spacer locatable between a first substrate and a second substrate, the first substrate and the second substrate together with a sealing member forming a vacuum vessel subject to pressure applied to the vacuum vessel, the spacer comprising:

a spacer body comprising a side extending between the first and second substrates and having a surface roughness on the side;

a resistance layer on the side of the spacer body; and a flattening layer on the resistance layer, the flattening layer having a thickness greater than a thickness of the resistance layer and having a surface roughness less than the surface roughness of the spacer body.

2. The spacer of claim 1, wherein the resistance layer has a specific resistance of $10^5$-$10^8$ Ωm, and has a thickness of 0.5-1 μm.

3. The spacer of claim 1, wherein the flattening layer has a thickness of 1-1.5 μm, and has a surface roughness of 0.01-0.1 μm.

4. The spacer of claim 1, wherein the flattening layer comprises an insulating material or a resistant material having a specific resistance greater than a specific resistance of the resistance layer.

5. A method of manufacturing a spacer, the method comprising:

forming a spacer body having a surface with a surface roughness by patterning a spacer body material;

forming a resistance layer covering at least one lateral side of the spacer body by coating a resistant material onto the lateral side of the spacer body; and forming a flattening layer over the resistance layer, the flattening layer having a thickness larger than a thickness of the resistance layer and having a surface roughness smaller than a surface roughness of the spacer body.

6. The method of claim 5, wherein the resistance layer has a specific resistance of $10^5$-$10^8$ Ωcm, and has a thickness of 0.5-1 μm.

7. The method of claim 5, wherein the flattening layer has a thickness of 1-1.5 μm, and has a surface roughness of 0.01-0.1 μm.

8. The method of claim 5, wherein the flattening layer is formed either by spraying or by dipping, and forming the flattening layer further comprises surface-treating the flattening layer.

9. The method of claim 5, wherein the flattening layer is formed from an insulating material or a material having a specific resistance greater than a specific resistance of the resistance layer.

10. An electron emission display comprising:

a first substrate and a second substrate facing each other and together with a sealing member forming a vacuum vessel;

an electron emission unit on the first substrate;

a light emission unit on the second substrate; and a plurality of spacers between the first and second substrates, wherein at least one of the spacers comprises a spacer body comprising a side extending between the first and second substrates and having a surface roughness on the side, a resistance layer on the side of the spacer body, and a flattening layer on the resistance layer, the flattening layer having a thickness greater than a thickness of the resistance layer and having a surface roughness less than the surface roughness of the spacer body.

11. The electron emission display of claim 10, wherein the resistance layer has a specific resistance of $10^5$-$10^8$ Ωcm, and has a thickness of 0.5-1 μm.

12. The electron emission display of claim 10, wherein the flattening layer has a thickness of 1-1.5 μm, and a surface roughness of 0.01-0.1 μm.

13. The electron emission display of claim 10, wherein the flattening layer comprises an insulating material or a resistant material having a specific resistance greater than a specific resistance of the resistance layer.

14. The electron emission display of claim 10, wherein the electron emission unit comprises cathode electrodes and gate electrodes insulated from each other, and electron emission regions electrically connected to the cathode electrodes.

15. The electron emission display of claim 14, wherein the electron emission unit further comprises a focusing electrode placed over the cathode electrodes and the gate electrodes such that the focusing electrode is insulated from the cathode electrodes and the gate electrodes.

16. The electron emission display of claim 10, wherein the electron emission unit comprises:

a first conductive thin film and a second conductive thin film spaced from each other;

first electrodes electrically connected to the first conductive thin film;

second electrodes electrically connected to the second conductive thin film, and electron emission regions disposed between the first conductive thin film and the second conductive thin film.

17. The electron emission display of claim 10, wherein the light emission unit comprises:

phosphor layers;

a black layer between the phosphor layers; and an anode electrode on a surface of the phosphor layers and the black layer.

18. The electron emission display of claim 10, wherein:

the first substrate and the second substrate include:

an active area having the electron emission unit and the light emission unit, respectively; and a non-active area located external to the active area, and the spacers include:

first spacers at the active area; and second spacers at the non-active area.

* * * * *